US009404704B2

(12) United States Patent
Packard et al.

(10) Patent No.: US 9,404,704 B2
(45) Date of Patent: Aug. 2, 2016

(54) MUZZLE FLASH SUPPRESSOR

(71) Applicant: Sig Sauer, Inc., Newington, NH (US)

(72) Inventors: Harry Andrew Packard, Amesbury, MA (US); Ethan Lessard, East Kingston, NH (US)

(73) Assignee: Sig Sauer, Inc., Newington, NH (US)

( * ) Notice: Subject to any disclaimer, the term of this patent is extended or adjusted under 35 U.S.C. 154(b) by 18 days.

(21) Appl. No.: 14/464,862

(22) Filed: Aug. 21, 2014

(65) Prior Publication Data

US 2015/0308775 A1 Oct. 29, 2015

Related U.S. Application Data

(60) Provisional application No. 61/868,295, filed on Aug. 21, 2013.

(51) Int. Cl.
*F41A 21/00* (2006.01)
*F41A 21/34* (2006.01)

(52) U.S. Cl.
CPC ..... *F41A 21/34* (2013.01)

(58) Field of Classification Search
CPC ..... F41G 3/06; F41G 3/08; F41G 1/473; F41G 1/54; F41G 3/02; F41G 1/35; F41G 1/38; F41G 1/30; F41G 3/326; F41G 1/00; F41G 1/545; F41G 3/142; F41G 3/145; F41G 3/2627; F41G 3/2644; F41G 3/2655
USPC ..... 42/113, 114; 89/14.2, 14.3
See application file for complete search history.

(56) References Cited

U.S. PATENT DOCUMENTS 4,570,529 A * 2/1986 A'Costa ..... F41A 21/34 42/78
4,664,014 A * 5/1987 Hawley ..... F41A 21/34 89/14.2
4,893,544 A * 1/1990 Hawley ..... F41A 21/34 89/14.2
5,005,463 A * 4/1991 A'Costa ..... F41A 21/34 89/14.2
5,092,223 A * 3/1992 Hudson ..... F41A 21/38 89/14.2
5,359,779 A * 11/1994 Polk ..... F41G 1/35 33/DIG. 21
5,410,815 A * 5/1995 Parikh ..... F41A 33/02 33/275 R (Continued)

OTHER PUBLICATIONS

Smith Enterprise, Inc., "Vortex .50 Cal M2HB Quick-Disconnect Flash Eliminator," Oct. 17, 2005, 6 pgs.

(Continued)

*Primary Examiner* — Samir Abdosh
(74) *Attorney, Agent, or Firm* — Finch & Maloney PLLC

(57) ABSTRACT

A muzzle flash suppressor is disclosed. In accordance with some embodiments, the disclosed flash suppressor includes a plurality of prongs having inner surfaces which taper along their length, providing angled expansion of the primary bore of the flash suppressor in the direction of projectile travel. The inner prong surfaces located along the gas flow path angle outwardly, a multi-radius surface is formed between each pair of neighboring prongs, and chamfers and radii are provided at the prong ends. Some embodiments provide for balanced and gradual gas expansion axially and/or radially along the projectile path, thereby allowing muzzle gases to expand/bleed off in a substantially laminar pattern. In some cases, this reduces secondary ignition of muzzle gases and the ambient air, thereby reducing muzzle flash. Also, some embodiments provide for easy clearance or correction of muzzle obstructions, thereby protecting against damage to the flash suppressor and host weapon.

21 Claims, 5 Drawing Sheets

(56) References Cited

U.S. PATENT DOCUMENTS

| | | | | | |
|---|---|---|---|---|---|
| 5,491,546 | A * | 2/1996 | Wascher | F41G 1/38 | 356/20 |
| 5,596,161 | A * | 1/1997 | Sommers | F41A 21/34 | 89/14.2 |
| 6,124,968 | A * | 9/2000 | Pieri | F41H 5/266 | 359/402 |
| 6,230,431 | B1 * | 5/2001 | Bear | F41G 1/35 | 362/114 |
| 6,837,139 | B2 | 1/2005 | Meyers | | |
| 7,302,774 | B2 | 12/2007 | Meyers | | |
| D577,410 | S | 9/2008 | Brittingham | | |
| D610,221 | S | 2/2010 | Brittingham | | |
| 7,796,329 | B2 * | 9/2010 | Dobschal | F41G 1/30 | 359/1 |
| 7,861,636 | B1 * | 1/2011 | Hoffman | F41A 21/34 | 89/14.2 |
| 7,905,170 | B1 | 3/2011 | Brittingham et al. | | |
| 7,926,404 | B2 | 4/2011 | Brittingham | | |
| D646,345 | S * | 10/2011 | Oliver | D22/108 | |
| D647,588 | S | 10/2011 | Heath | | |
| 8,061,254 | B2 * | 11/2011 | Heath | F41A 21/34 | 89/14.2 |
| 8,104,394 | B2 * | 1/2012 | Meyers | F41A 21/34 | 42/77 |
| 8,453,789 | B1 * | 6/2013 | Honigmann | F41A 21/30 | 181/223 |
| 9,062,932 | B2 * | 6/2015 | Houde-Walter | F41G 1/35 | |

OTHER PUBLICATIONS

Advanced Armament Corporation, "Blackout 18T Flash Hider," www.advanced-armament.com/BLACKOUT-18T-Flash-Hider_p_446.html, accessed Dec. 12, 2012, 1 pg.

Smith Enterprises, Inc., "Vortex Flash Eliminators," www.smithenterprise.com/products06.01.html, accessed Dec. 12, 2012, 1 pg.

DiGiulian, Tony, "Muzzle Flash," http://www.navweaps.com/index_tech/tech-090.htm, Sep. 12, 2006, 2 pgs.

Smith Enterprise, Inc., "Smith Enterprise Vortex G6A2 Sound Suppressor Capable Flash Eliminator," Oct. 6, 2010, 1 pg.

"Vortex Flash Hider," http://en.wikipedia.org/wiki/Vortex_Flash_Hider, accessed May 8, 2013, 3 pgs.

"Flash Suppressor," http://en.wikipedia.org/wiki/Flash_suppressor, accessed May 9, 2013, 4 pgs.

"Muzzle Flash," http://en.wikipedia.org/wiki/Muzzle_flash, accessed May 15, 2013, 4 pgs.

* cited by examiner

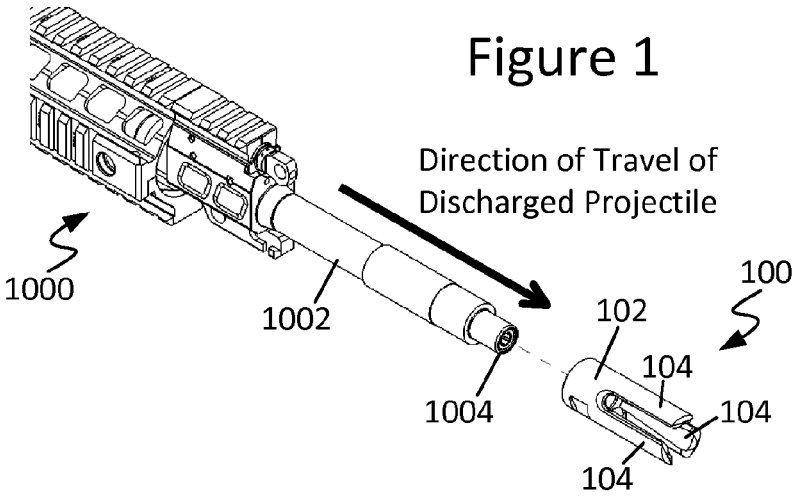
Figure 1
Figure 2
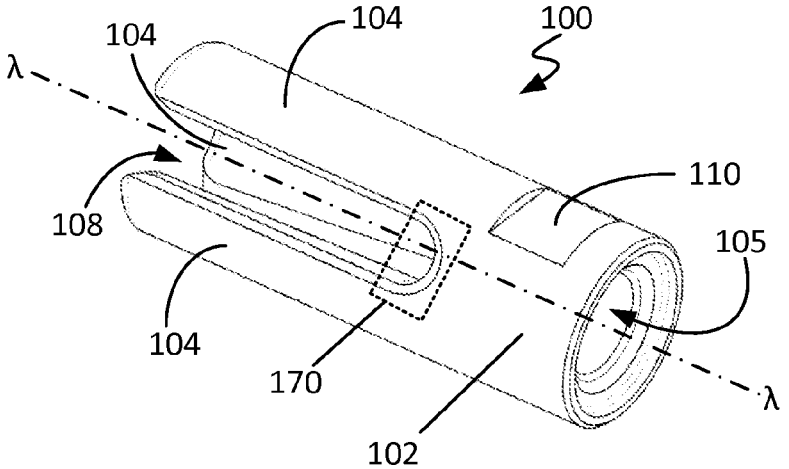
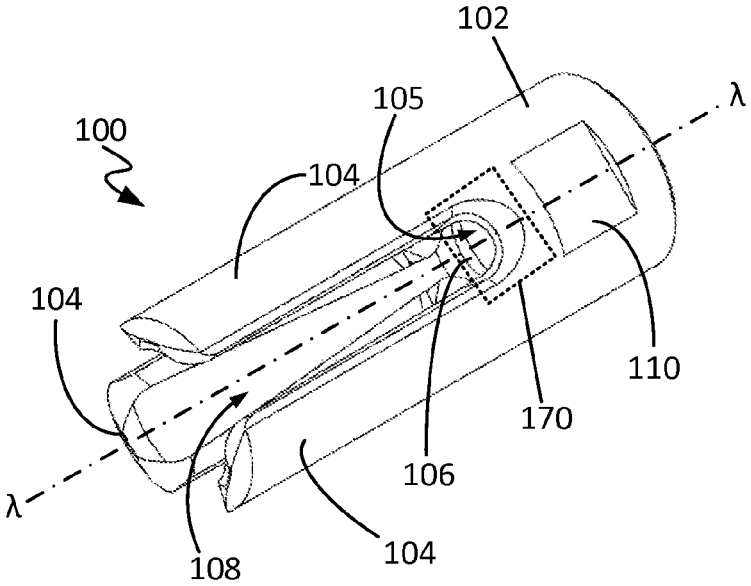
Figure 3

MUZZLE FLASH SUPPRESSOR

CROSS-REFERENCE TO RELATED APPLICATIONS

This application claims the benefit of U.S. Provisional Patent Application No. 61/868,295, filed on Aug. 21, 2013, which is herein incorporated by reference in its entirety.

FIELD OF THE DISCLOSURE

The disclosure relates to projectile weapons and more particularly to accessories for use with projectile weapons.

BACKGROUND

Weapons design involves a number of non-trivial challenges, and projectile weapons have faced particular complications with regard to muzzle flash.

SUMMARY

One example embodiment of the present disclosure provides a flash suppressor including: a socket portion configured to couple with a muzzle of a projectile weapon, wherein the socket portion has an opening formed therethrough, the opening commensurate in size with an inner bore of the muzzle; and a plurality of prongs extending from the socket portion, wherein the prongs are arranged such that an interior space surrounded by the prongs provides an exit cavity, and wherein a first end of the exit cavity transitions to the opening of the socket portion and a second end of the exit cavity opens to allow passage of a projectile out of the flash suppressor, the exit cavity exhibiting angled expansion from the first end thereof to the second end thereof. In some cases, each prong tapers in thickness along its length from the first end of the exit cavity to the second end of the exit cavity such that its inner surfaces diverge from a central axis of the flash suppressor. In some instances, each prong includes a chamfered end surface and/or a radiused end surface proximal the second end of the exit cavity. In some cases, the exit cavity exhibits angled expansion at an angle in the range of about 5°±2°. In some instances, the flash suppressor further includes: a plurality of multi-radius surfaces, each multi-radius surface formed between a pair of neighboring prongs, wherein each multi-radius surface transitions from the exit cavity to an exterior of the flash suppressor, each multi-radius surface exhibiting angled expansion from the exit cavity to the exterior of the flash suppressor. In some such instances, each multi-radius surface includes a portion which expands at an angle in the range of about 60°±5° relative to a central axis of the flash suppressor. Also, in some such instances, each multi-radius surface exhibits a first stage of angled radial width expansion at an angle in the range of about 10°±2°. In some such cases, each multi-radius surface further exhibits a second stage of angled radial width expansion at an angle in the range of about 90°±5°, the first stage of angled radial width expansion more proximal to the exit cavity than the second stage of angled radial width expansion. In some instances, the flash suppressor has a generally cylindrical tubular geometry. In some cases, the plurality of prongs comprises three prongs spaced equidistantly from one another about a perimeter of the socket portion. In some instances, the socket portion is configured to receive a threaded muzzle. In some cases, the socket portion includes one or more set screws configured to tighten against an exterior of the muzzle. In some instances, the socket portion includes wrench flats formed therein. In some instances, the flash suppressor provides for expansion of muzzle gases in substantially parallel layers. In some such instances, such expansion is provided axially and/or radially with respect to the muzzle. In some cases, all prong surfaces along a muzzle gas path are angled outwardly with respect to the muzzle in a direction from the muzzle to the second end of the exit cavity. In some cases, the exit cavity exhibits angled expansion at an angle which permits clearance of a muzzle obstruction upon incidence of a projectile therewith.

In some cases, a projectile weapon including the flash suppressor is provided. In some such cases, the projectile weapon comprises a pistol, a rifle, a machine gun, or an autocannon. In some instances, the projectile weapon is chambered for projectiles having a caliber in the range of 0.22 long rifle (LR) rounds to 30 mm rounds. In some cases, the projectile weapon comprises a rifle chambered for 5.56×45 mm NATO rounds. In some other cases, the projectile weapon comprises a rifle chambered for 7.62×39 mm rounds. In some instances, the socket portion of the flash suppressor includes a stopping position which permits one prong of the plurality of prongs to be indexed at a 12-o-clock position with respect to the muzzle.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

BRIEF DESCRIPTION OF THE DRAWINGS

FIG. 1 is a perspective view of a flash suppressor configured to be operatively coupled with a projectile weapon, in accordance with an embodiment of the present disclosure.

FIG. 2 is a perspective view of a flash suppressor configured in accordance with an embodiment of the present disclosure.

FIG. 3 is a perspective view of a flash suppressor configured in accordance with an embodiment of the present disclosure.

Figure 4:
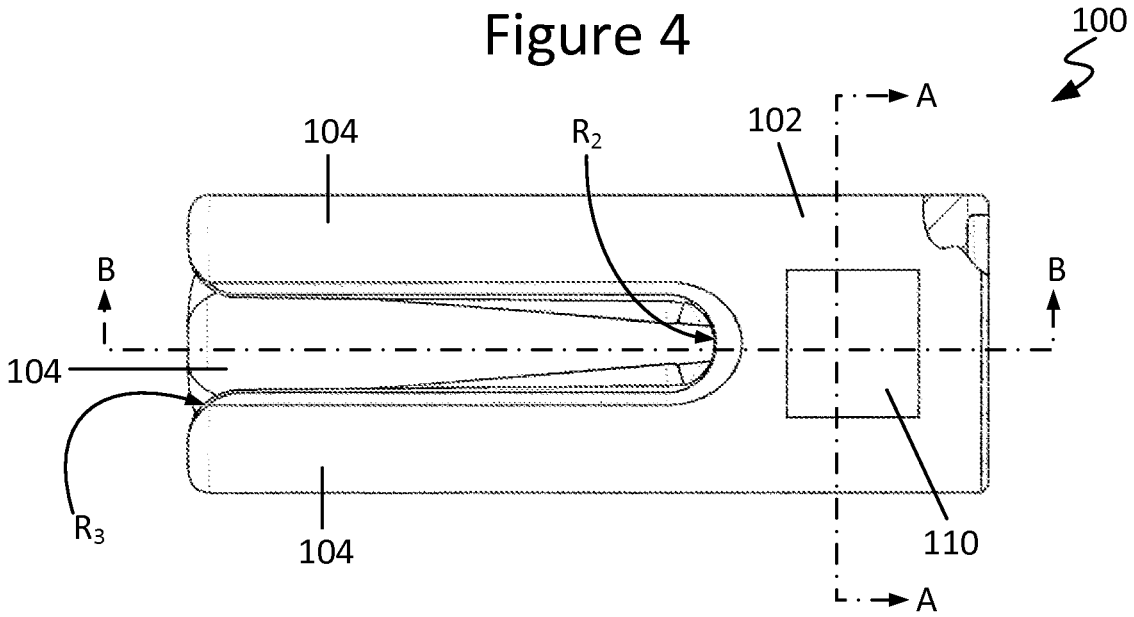
FIG. 4 is a side view of a flash suppressor configured in accordance with an embodiment of the present disclosure.
Figure 5:
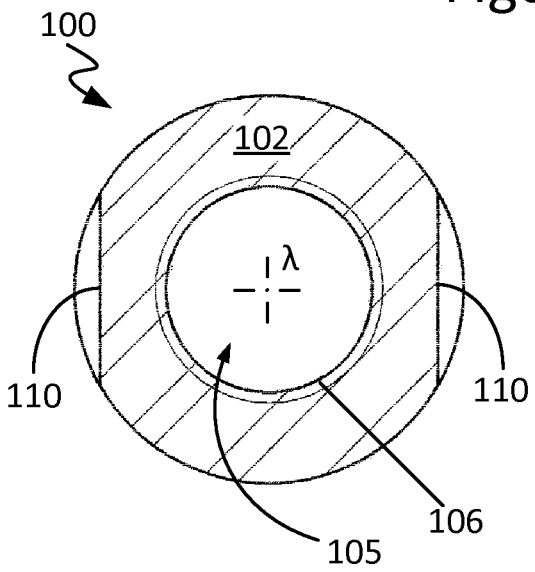
FIG. 5 is a cross-sectional view of the flash suppressor of FIG. 4 taken along line A-A therein.
Figure 6:
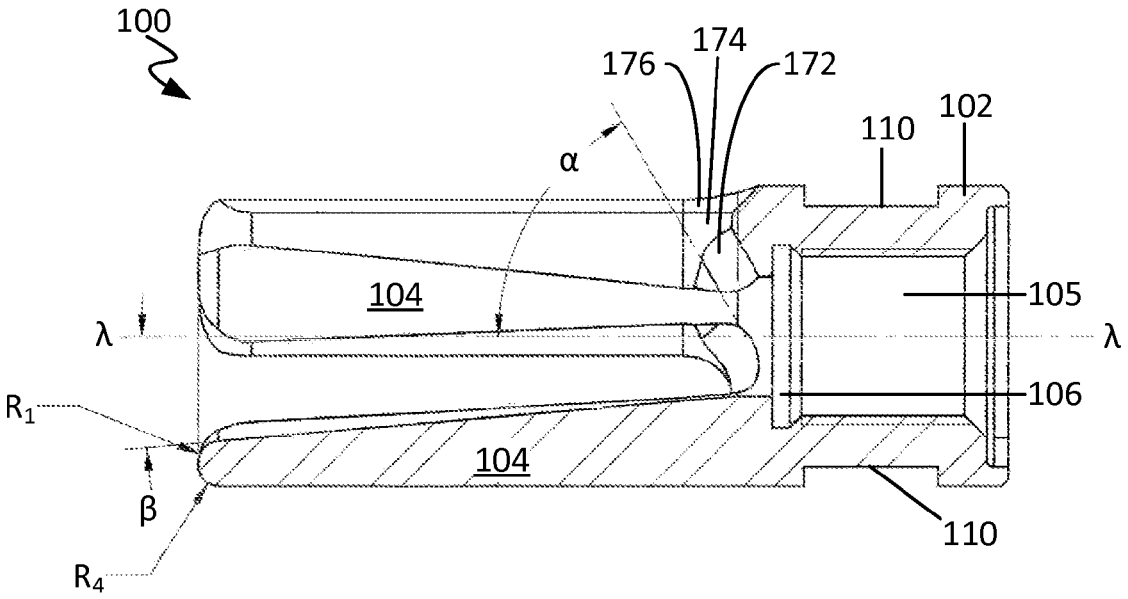
FIG. 6 is a cross-sectional view of the flash suppressor for FIG. 4 taken along line B-B therein.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the present disclosure to the specific configurations shown. In short, the figures are provided merely to show example structures.

DETAILED DESCRIPTION

A muzzle flash suppressor is disclosed. In accordance with some embodiments, the disclosed flash suppressor includes a plurality of prongs having inner surfaces which taper along their length, providing angled expansion of the primary bore of the flash suppressor in the direction of projectile travel. The inner prong surfaces located along the gas flow path angle outwardly, a multi-radius surface is formed between each pair of neighboring prongs, and chamfers and radii are provided at the prong ends. Some embodiments provide for balanced and gradual gas expansion axially and/or radially along the projectile path, thereby allowing muzzle gases to expand/bleed off in a substantially laminar pattern. In some cases, this reduces secondary ignition of muzzle gases and the ambient air, thereby reducing muzzle flash. Also, some embodiments provide for easy clearance or correction of muzzle obstructions, thereby protecting against damage to the flash suppressor and host weapon. Numerous configurations and variations will be apparent in light of this disclosure.

General Overview

As previously indicated, there are a number of non-trivial issues that can arise which can complicate weapons design. For instance, one non-trivial issue pertains to the fact that the discharge of a projectile weapon normally produces a muzzle flash. It is generally understood that several flash components contribute to the overall muzzle flash observable during the discharge of a projectile weapon. The flash component known as secondary flash generally makes the largest contribution of radiated energy during discharge. Secondary flash is caused by ignition of the high-temperature, high-pressure mixture of combustible propellant gases from the projectile cartridge/round and atmospheric oxygen in the ambient air. Secondary flash generally occurs at the boundary of the gas jet as it escapes the muzzle of the projectile weapon. When observed in a low-light environment (e.g., nighttime, dimly lit room, etc.), a muzzle flash of sufficient brightness can impair the shooter's low-light vision (e.g., cause an afterimage, interfere with darkness adaptation, impede device-based night vision), in some cases effectively temporarily blinding the shooter. Also, muzzle flash can negatively impact the shooter's visible signature by revealing the presence/position of the shooter to an enemy or otherwise detracting from the shooter's ability to maintain a stealthy presence (e.g., especially in a low-light environment), which may pose a particular hazard, for example, for military, tactical, and law enforcement personnel, for instance.

Another non-trivial issue pertains to the fact that existing muzzle flash suppressor designs are susceptible to muzzle obstruction-related damage in several ways. For example, muzzle obstruction can occur directly, such as in cases of flash suppressor component deformation (e.g., the flash suppressor hits a solid object such as a rock, a building wall, or the ground with sufficient force to deform the component). Also, muzzle obstruction can occur indirectly, such as in cases in which foreign matter becomes lodged within or otherwise retained by the flash suppressor component. Mud, dirt, sand, small stones, debris, and other environmental hazards which may be regularly encountered in the field can enter the flash suppressor when the host rifle is dropped or otherwise placed in such media. In any case, muzzle obstruction can impede or otherwise reduce the effectiveness of a projectile weapon and, in some instances, may pose a significant safety hazard to the shooter.

A muzzle flash suppressor configured as described herein may include, in accordance with some embodiments, a plurality of prongs having inner surfaces which taper along their length, thereby providing angled expansion of the primary bore of the flash suppressor in the direction of projectile travel. The inner prong surfaces located along the gas flow path may be angled outwardly relative to the central axis of the flash suppressor, and chamfers and radii may be provided at the prong ends. Furthermore, a multi-radius surface, discussed herein, may be formed between each pair of neighboring prongs.

In some embodiments, a flash suppressor configured as described herein may provide for balanced and gradual gas expansion axially and/or radially along the projectile path, thereby allowing gases from a discharged projectile to expand/bleed off in a substantially laminar pattern. That is, the disclosed flash suppressor may be configured to modify the gas flow pattern exiting the muzzle of a projectile weapon so as to cause the gases to flow in substantially parallel layers with no or otherwise minimal disruption there between. In some cases, and in accordance with some embodiments, this may help to eliminate or otherwise reduce secondary ignition of muzzle gases and the ambient air, thus inhibiting secondary flash and thereby reducing the overall muzzle flash. As will be appreciated in light of this disclosure, a reduction in muzzle flash may help to preserve the shooter's low-light vision (e.g., scotopic vision, device-based night vision) and/or reduce the visible signature of the shooter. Also, some embodiments may be configured to divert any remaining incandescent gases away from the line of sight of the shooter, further helping to preserve the shooter's low-light vision.

In some embodiments, a flash suppressor configured as described herein may provide a degree of protection against damage to the flash suppressor and/or host weapon as otherwise would result from a muzzle obstruction caused by foreign matter, component deformation, etc. For instance, some embodiments may reduce the likelihood that foreign matter will become lodged within the disclosed flash suppressor and thus obstruct the muzzle of the host weapon. Some embodiments may reduce the likelihood that foreign matter which does become lodged within the disclosed flash suppressor will fail to eject/clear upon incidence with a discharged projectile. Some embodiments may increase the likelihood that, should the disclosed flash suppressor become deformed in a manner which (correctably) obstructs the muzzle of the host weapon, a discharged projectile which is incident with the deformed portion of the flash suppressor will provide some degree of corrective or otherwise counteractive deformation thereof. Thus, in some instances, a flash suppressor configured as described herein may improve the performance and reliability of the host weapon and safety to the shooter by realizing a reduction in the likelihood of mechanical failure of the weapon system.

As will be appreciated in light of this disclosure, and in accordance with some embodiments, a flash suppressor configured as described herein can be utilized with any of a wide range of projectile weapons, such as, but not limited to, a pistol, a rifle, a machine gun, or an autocannon. In accordance with some example embodiments, a flash suppressor configured as described herein can be utilized with projectile weapons chambered for projectiles ranging in caliber from 0.22 long rifle (LR) rounds to 30 mm rounds. In some example cases, the disclosed flash suppressor can be configured to be utilized with a rifle which is chambered, for example, for 5.56×45 mm NATO rounds or 7.62×39 mm rounds, such as the SIG516™, SIG556™, or SIGM400™ rifles produced by Sig Sauer, Inc. Other suitable host weapons and projectile calibers will be apparent in light of this disclosure.

Some embodiments may include small form factor components constructed from materials which are lightweight, resilient, inexpensive, etc. In some such instances, minimal (or otherwise negligible) mass and/or bulk may be added to the host weapon, thereby helping to maintain a reliable, lightweight, compact weapon system. Also, in some instances, a reduction in cost (e.g., of production, of repair, of replacement, etc.) may be realized.

In accordance with some embodiments, use of the disclosed apparatus may be detected, for example, by visual inspection of a muzzle flash suppressor having features such as a primary bore which exhibits angled expansion, outwardly angled interior prong surfaces, prong ends with chamfers and radii, and/or multi-radius surfaces between neighboring prongs, as variously described herein. Also, it should be noted that, while generally referred to herein as a 'flash suppressor' for consistency and ease of understanding of the present disclosure, the disclosed flash suppressor is not so limited to that specific terminology and alternatively can be referred to, for example, as a flash guard, flash eliminator, flash hider, or flash cone in other embodiments, as will be appreciated in light of this disclosure. As will be further appreciated, the particular configuration (e.g., materials, dimensions, etc.) of a flash suppressor configured as described herein may be varied, for example, depending on whether the target application or end-use is military, tactical, or civilian in nature. Numerous configurations will be apparent in light of this disclosure.

Structure and Operation

FIG. 1 illustrates a flash suppressor 100 configured to be operatively coupled with a projectile weapon 1000, in accordance with an embodiment of the present disclosure. As can be seen, flash suppressor 100 has a generally cylindrical tubular geometry and includes a socket portion 102 and a plurality of prongs 104 extending therefrom, as discussed below. The muzzle 1004 of barrel 1002 of a host weapon 1000 may be threaded or unthreaded as traditionally done, and flash suppressor 100 may be configured accordingly to be operatively coupled with muzzle 1004, in accordance with some embodiments. Flash suppressor 100 may be operatively coupled with muzzle 1004 in a permanent or temporary manner, as desired for a given target application or end-use.

As will be appreciated in light of this disclosure, a flash suppressor 100 configured as described herein may be utilized with any of a wide variety of projectile weapons 1000, such as, but not limited to, a pistol, a rifle, a machine gun, or an autocannon. In accordance with some example embodiments, flash suppressor 100 may be configured to be utilized with a projectile weapon 1000 chambered for projectiles, for example, ranging in caliber from 0.22 long rifle (LR) rounds to 30 mm rounds (e.g., 5.56×45 mm NATO rounds, 7.62×39 mm rounds, etc.). Other suitable host weapons 1000 and projectile calibers with which flash suppressor 100 may be utilized will be apparent in light of this disclosure.

Also, flash suppressor 100 can be constructed from any suitable material(s), as will be apparent in light of this disclosure. For example, in some embodiments, flash suppressor 100 can be constructed from AISI 4130 steel. It may be desirable in some instances to ensure that flash suppressor 100 comprises a material (or combination of materials), for example, which is corrosion-resistant, reliable over a large temperature range (e.g., in the range of about −50° F. to 170° F.), and/or resistant to deformation and/or fracture. In a more general sense, flash suppressor 100 can be constructed from any suitable material which is compliant, for example, with United States Defense Standard MIL-W-13855 (Weapons: Small Arms and Aircraft Armament Subsystems, General Specification For). Other suitable materials for flash suppressor 100 will depend on a given application and will be apparent in light of this disclosure.

In some cases, flash suppressor 100 optionally can be configured to be operatively interfaced with any of a wide variety of other weapon accessories. For example, some embodiments may be configured to be operatively interfaced with a blank firing device (e.g., as may be used for training exercises or other instances in which blank cartridges are utilized). Some embodiments may be configured to be operatively interfaced with a brush guard (e.g., which may be used to help reduce the likelihood of becoming entangled with vegetation and similar environmental hazards). Some embodiments may be configured to permit attachment of a bayonet, light source, etc., on the host weapon 1000. Some embodiments may be configured to be operatively interfaced with a sound suppressor (e.g., which may be utilized to help reduce the audible signature of the host weapon 1000). Other suitable accessories with which flash suppressor 100 optionally may be interfaced will depend on a given application and will be apparent in light of this disclosure.

FIGS. 2-6, 7A-7B, and 8A-8D illustrate several views of a flash suppressor 100 configured in accordance with an embodiment of the present disclosure. Socket portion 102 may be configured to permit flash suppressor 100 to be operatively coupled with muzzle 1004 in a temporary or permanent manner, as desired for a given target application or end-use. To that end, socket portion 102 may have formed therein a recess 105 configured to be mated or otherwise engaged with muzzle 1004. In some embodiments, recess 105 can be threaded such that socket portion 102 may be screwed onto a correspondingly threaded muzzle 1004 to affix socket portion 102 (and thus flash suppressor 100) thereto. In some other embodiments, recess 105 may be configured to receive muzzle 1004, and one or more set screws in the sidewall of socket portion 102 may be tightened against the outside of muzzle 1004 to affix socket portion 102 (and thus flash suppressor 100) thereto.

Flash suppressor 100 may be coupled with muzzle 1004 such that muzzle 1004 comes into physical register with an opening 106 formed within socket portion 102. As will be appreciated in light of this disclosure, it may be desirable to ensure that the dimensions and alignment of opening 106 are sufficient to minimize or otherwise reduce the likelihood of contact between a discharged projectile and the interior sidewall of socket portion 102 which defines opening 106. To that end, and in accordance with some embodiments, opening 106 may be configured, for example, such that: (1) its inner diameter/width is commensurate with the inner bore of muzzle 1004 (e.g., the inner diameter/width of opening 106 is within about a 2% difference of the inner diameter/width of the inner bore of muzzle 1004 of the host weapon 1000); and/or (2) it substantially aligns (e.g., is precisely aligned or otherwise within an acceptable tolerance) with the inner bore of muzzle 1004 along central axis λ.

In some embodiments, socket portion 102 optionally may include one or more wrench flats 110 formed therein, which may be utilized in securing and removing flash suppressor 100 from the host weapon 1000. In an example case, the optional wrench flats 110 may be positioned substantially opposite one another about the outer circumference of socket portion 102. Also, and in accordance with some embodiments, the dimensions (e.g., length, outer diameter/width, inner diameter/width, etc.) of socket portion 102 can be customized as desired for the particular muzzle 1004 with which flash suppressor 100 is to be operatively coupled.

As previously noted, and in accordance with some embodiments, socket portion 102 may have a plurality of prongs 104 extending therefrom substantially parallel to central axis λ. In an example embodiment, flash suppressor 100 may have three prongs 104 formed about the perimeter of socket portion 102. In some such cases, prongs 104 may be spaced equidistantly (e.g., a given pair of neighboring prongs 104 are approximately 120° offset from one another about the perimeter of socket portion 102). It should be noted, however, that the present disclosure is not so limited, and other suitable quantities and/or arrangements of prongs 104 will depend on a given application and will be apparent in light of this disclosure. Also, the dimensions (e.g., length, width, thickness) of a given prong 104 can be customized as desired for a given target application or end-use.

In any case, a given prong 104 may be formed with a plurality of inner and outer surfaces. For example, consider FIGS. 8A-8D, which illustrate partial cutaway views of a flash suppressor 100 configured in accordance with an embodiment of the present disclosure. As can be seen, a given prong 104 may include an inner central surface 152 which extends along the length of prong 104. Inner central surface 152 may expand in width progressing from its proximal end (e.g., proximal relative to socket portion 102) to its distal end (e.g., distal relative to socket portion 102). Also, inner central surface 152 may exhibit a generally concave curvature from side to side along the length of prong 104.

The proximal end of inner central surface 152 may transition to opening 106 of socket portion 102. Inner recessed surfaces 172 may be formed on either side of the proximal end of inner central surface 152. A given inner recessed surface 172 may exhibit a generally concave curvature from side to side and may transition to opening 106 alongside inner central surface 152. Also, as can be seen, for example, with reference to FIGS. 6 and 7B, a given inner recessed surface 172 may be configured such that it expands outwardly (e.g., relative to central axis λ and passing from a portion proximal to opening 106 to a U-shaped surface 174) at an angle α. In accordance with some embodiments, angle α may be in the range of about 30°-70° (e.g., about 30°-40°, about 40°-50°, about 50°-60°, about 60°-70°, or any other sub-range in the range of about 30°-70°). In some example cases, angle α may be about 60°±5°. Other suitable ranges for angle α will depend on a given application and will be apparent in light of this disclosure.

The distal end of inner central surface 152 may transition to an end surface 154. End surface 154 may exhibit a concave curvature from side to side along prong 104, similar to inner central surface 152. End surface 154 also may include one or more chamfers and/or radii, such as radius $R_1$ in FIG. 6. In accordance with some embodiments, radius $R_1$ may be in the range of about 0.01-0.20 inches (e.g., about 0.01-0.05 inches, about 0.05-0.10 inches, about 0.10-0.15 inches, about 0.15-0.20 inches, or any other sub-range in the range of about 0.01-0.20 inches). In some example cases, radius $R_1$ may be about 0.06±0.02 inches. Other suitable ranges for radius $R_1$ will depend on a given application and will be apparent in light of this disclosure.

As can further be seen, the inner surfaces of a given prong 104 also may include inner side surfaces 156*a* and 156*b* which run adjacent to inner central surface 152. The proximal end of inner side surface 156*a* may transition to a U-shaped surface 174, and the proximal end of inner side surface 156*b* similarly may transition to another U-shaped surface 174. Each U-shaped surface 174 may be disposed between adjacent prongs 104, and thus may serve to transition an inner side surface 156*b* of a first prong 104 to an inner side surface 156*a* of an adjacent prong 104. Thus, in a sense, a given U-shaped surface 174 may be thought of as being shared by a given pair of adjacent prongs 104. A given U-shaped surface 174 may have a root radius at its base, such as radius $R_2$ in FIG. 4. In accordance with some embodiments, radius $R_2$ may be in the range of about 0.05-0.30 inches (e.g., about 0.05-0.10 inches, about 0.10-0.15 inches, about 0.15-0.20 inches, about 0.20-0.25 inches, about 0.25-0.30 inches, or any other sub-range in the range of about 0.05-0.30 inches). In some example cases, radius $R_2$ may be about 0.12±0.05 inches. Other suitable ranges for radius $R_2$ will depend on a given application and will be apparent in light of this disclosure.

The distal end of inner side surface 156*a* may transition to an end surface 158*a*, and the distal end of inner side surface 156*b* similarly may transition to an end surface 158*b*. The end surfaces 158*a* and 158*b* may be located adjacent to either side of end surface 154 and may include one or more chamfers and/or radii, such as radius $R_3$ in FIG. 4. In accordance with some embodiments, radius $R_3$ may be in the range of about 0.05-0.30 inches (e.g., about 0.05-0.10 inches, about 0.10-0.15 inches, about 0.15-0.20 inches, about 0.20-0.25 inches, about 0.25-0.30 inches, or any other sub-range in the range of about 0.05-0.30 inches). In some example cases, radius $R_3$ may be about 0.15±0.05 inches. Other suitable ranges for radius $R_3$ will depend on a given application and will be apparent in light of this disclosure.

The side of a given prong 104 may include an outer side surface 160*a* which runs adjacent to inner side surface 156*a*, and an outer side surface 160*b* which runs adjacent to inner side surface 156*b*. The distal end of outer side surface 160*a* may transition to end surface 158*a*, and the distal end of outer side surface 160*b* may transition to end surface 158*b*. The proximal end of outer side surface 160*a* may transition to an outer recessed surface 176, and the proximal end of outer side surface 160*b* similarly may transition to another outer recessed surface 176. Each outer recessed surface 176 may be disposed between adjacent prongs 104, and thus may serve to transition an outer side surface 160*b* of a first prong 104 to an outer side surface 160*a* of an adjacent prong 104. Thus, in a sense, a given outer recessed surface 176 may be thought of as being shared by a given pair of adjacent prongs 104.

The exterior of a given prong 104 may include a back surface 162 which extends along the length of prong 104. Back surface 162 may be of substantially uniform width progressing from its proximal end (e.g., proximal relative to socket portion 102) to its distal end (e.g., distal relative to socket portion 102). Also, back surface 162 may exhibit a generally convex curvature from side to side along the length of prong 104. The proximal end of back surface 162 may transition to the outer sidewall of socket portion 102. The distal end of back surface 162 may transition to an end surface 164. End surface 164 may exhibit a generally convex curvature from side to side along prong 104, similar to back surface 162. End surface 164 also may include one or more chamfers and/or radii, such as radius $R_4$ in FIG. 6. In accordance with some embodiments, radius $R_4$ may be in the range of about 0.01-0.20 inches (e.g., about 0.01-0.05 inches, about 0.05-0.10 inches, about 0.10-0.15 inches, about 0.15-0.20 inches, or any other sub-range in the range of about 0.01-0.20 inches). In some example cases, radius $R_4$ may be about 0.06±0.02 inches. Other suitable ranges for radius $R_4$ will depend on a given application and will be apparent in light of this disclosure.

For ease of understanding of the present disclosure, the combination of the inner recessed surface 172, U-shaped surface 174, and/or outer recessed surface 176 (each discussed above) may be collectively referred to herein as a multi-radius surface 170. In accordance with some embodiments, a given multi-radius surface 170 may be formed between a given pair of neighboring prongs 104, proximal to socket portion 102. In some embodiments, a given multi-radius surface 170 may be provided, for example, by constituent surfaces 172, 174, and/or 176 which are joined at their vertices to transition from the interior to the exterior of flash suppressor 100 (e.g., such as can be seen in FIG. 7B). However, the present disclosure is not so limited, as in some other embodiments, a given multi-radius surface 170 may be provided, for example, by constituent surfaces 172, 174, and/or 176 which form a continuous contour (e.g., with no vertices but with a plurality of radii) when transitioning from the interior to the exterior of flash suppressor 100. In a more general sense, the quantity and/or angling of the constituent surfaces of a given multi-radius surface 170 may be varied as desired for a given target application or end-use. For instance, a given multi-radius surface 170 may include two, three, or more constituent surfaces of differing radii. Numerous suitable configurations will be apparent in light of this disclosure.

Figure 7A:
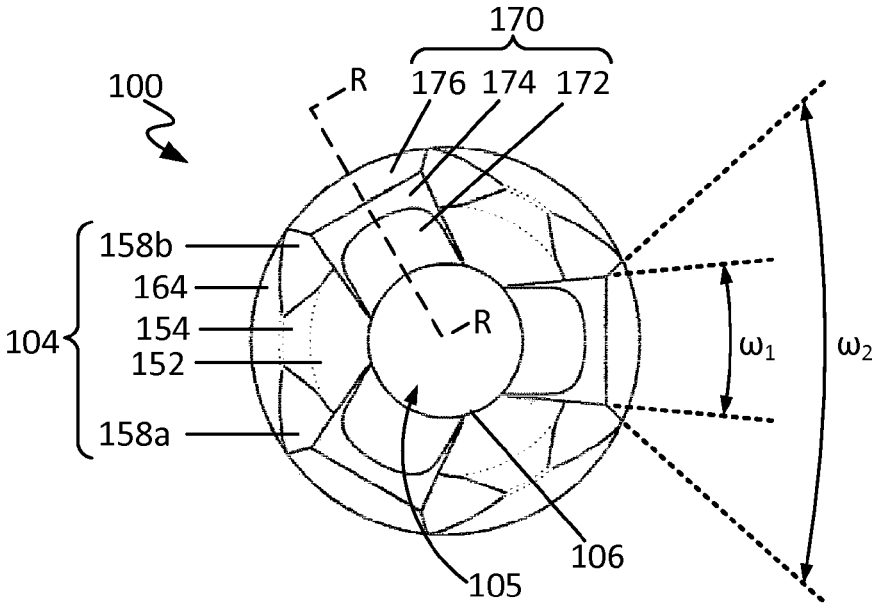
FIG. 7A is an end view of a flash suppressor configured in accordance with an embodiment of the present disclosure.
Figure 7B:
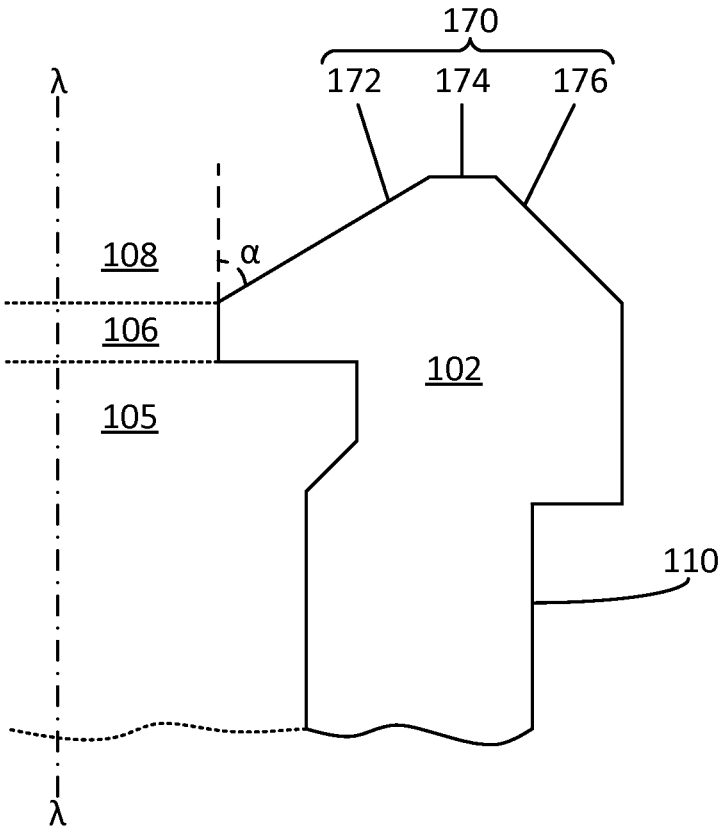
FIG. 7B is a partial cross-sectional view of the flash suppressor of FIG. 7A taken along line R-R therein.
Figure 8A:
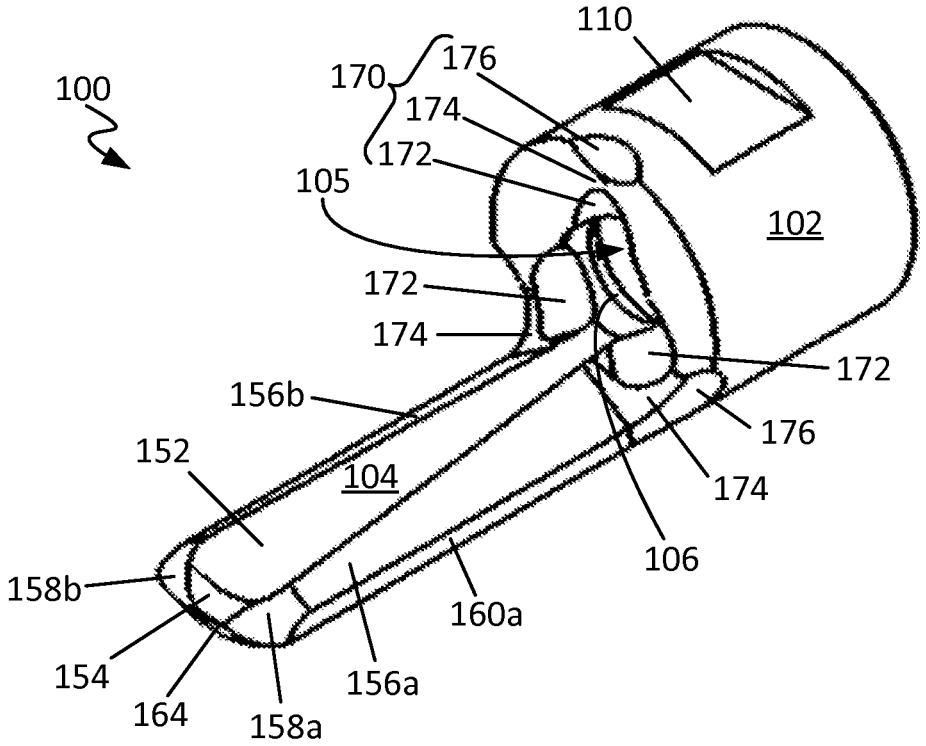
FIGS. 8A-8D are partial cutaway views of a flash suppressor configured in accordance with an embodiment of the present disclosure.
Figure 8D:
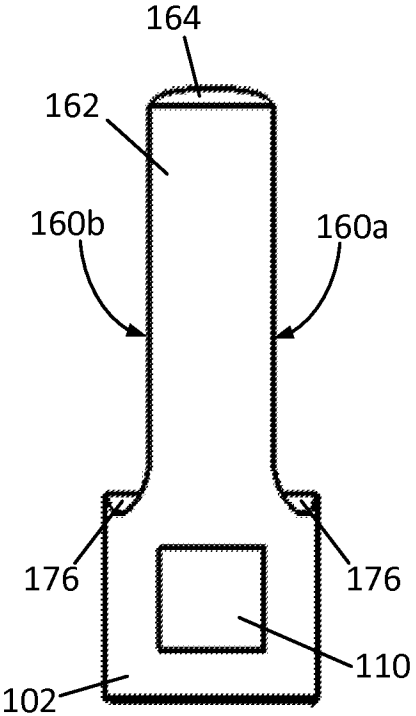
Figure 8C:
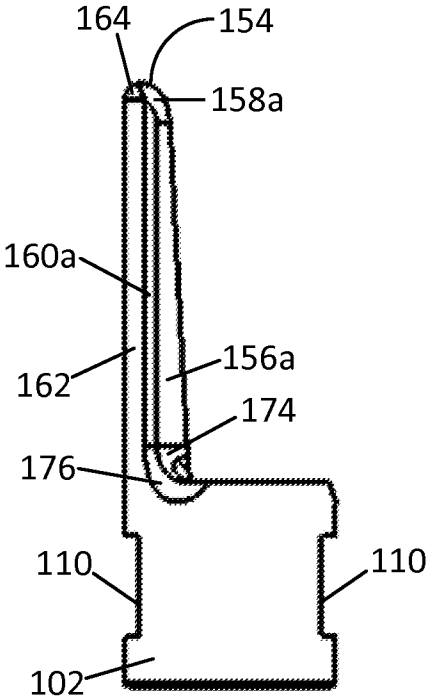
Figure 8B:
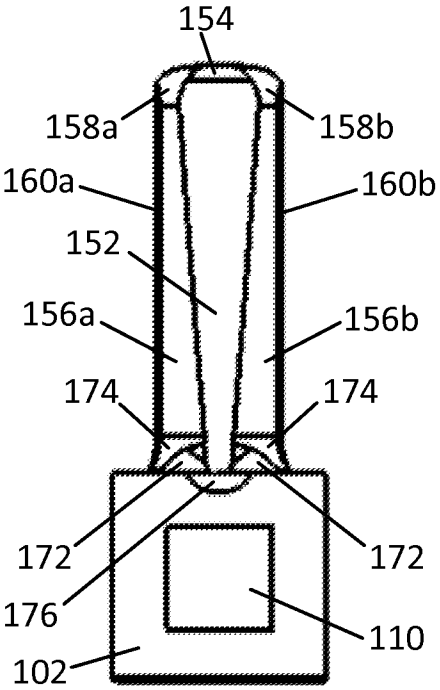

Also, as can be seen, for example, with reference to FIG. 7A, a given multi-radius surface 170 may exhibit expansion in radial width in the direction moving from the interior to the exterior of flash suppressor 100. That is, inner recessed surface 172 may expand in radial width at an angle $\omega_1$ as it transitions to U-shaped surface 174, which in turn may expand in radial width at an angle $\omega_2$ (e.g., which may be greater than angle $\omega_1$) as it transitions to outer recessed surface 176. In accordance with some embodiments, the first stage of angled expansion at angle $\omega_1$ may be in the range of about 1°-20° (e.g., about 1°-5°, about 5°-10°, about 10°-15°, about 15°-20°, or any other sub-range in the range of about 1°-20°). In some example cases, angle $\omega_1$ may be about 10°±2°. In accordance with some embodiments, the second stage of angled expansion at angle $\omega_2$ may be in the range of about 80°-100° (e.g., about 80°-85°, about 85°-90°, about 90°-95°, about 95°-100°, or any other sub-range in the range of about 80-100°). In some example cases, angle $\omega_2$ may be about 90°±5°. Other suitable ranges for angles $\omega_1$ and $\omega_2$ will depend on a given application and will be apparent in light of this disclosure.

As can further be seen from the figures, the inner space enclosed by prongs 104 generally defines an exit cavity 108. At its proximal end (e.g., proximal relative to socket portion 102), exit cavity 108 transitions to opening 106. At its distal end (e.g., distal relative to socket portion 102), exit cavity 108 opens to allow a discharged projectile to pass out of flash suppressor 100. As can be seen, for example, with reference to FIG. 6, a given prong 104 may be configured such that its thickness tapers (e.g., the inner surfaces of a prong 104 diverge from central axis λ) at an angle β along its length from its proximal end to its distal end. In accordance with some embodiments, angle β may be in the range of about 1°-10° (e.g., about 2°-5°, about 5°-8°, or any other sub-range in the range of about 1°-10°). In some example cases, angle β may be about 5°±2°. By virtue of this angled tapering of prongs 104, the inner diameter/width of exit cavity 108 (and thus the inner bore of flash suppressor 100) may expand along its length from its proximal end to its distal end. In other words, the inner bore of exit cavity 108 expands relative to the inner bore of opening 106 and muzzle 1004 as the prongs 104 taper in thickness along their length and their inner surfaces diverge from central axis λ, in accordance with some embodiments. In some cases, the tapering may be constant, while in some other cases, an increasing taper may be provided. In some instances, a given prong 104 may be configured such that its back surface 162 is substantially aligned with the exterior of socket portion 102, while in some other instances, its back surface 162 may be permitted to diverge from the circumference of socket portion 102. Other suitable configurations and ranges for angle β will depend on a given application and will be apparent in light of this disclosure.

As will be appreciated in light of this disclosure, during discharge of a host weapon 1000 having a flash suppressor 100 operatively coupled therewith, the discharged projectile travels through muzzle 1004, through opening 106, through exit cavity 108, and out of flash suppressor 100 generally in the direction along central axis λ. As previously noted, and in accordance with some embodiments, flash suppressor 100 may provide for balanced and gradual gas expansion axially and/or radially with respect to central axis λ, thereby allowing the muzzle gases to expand/bleed off in a substantially laminar pattern (e.g., the gases flow in substantially parallel layers with no or otherwise minimal disruption there between). In accordance with some embodiments, several features of flash suppressor 100 may contribute to that end, such as, for example: (1) the inner recessed surfaces 172, which exhibit angled expansion at angle α (e.g., relative to central axis λ); (2) the multi-radius surfaces 170 which exhibit angled expansion in radial width at angles $\omega_1$ and $\omega_2$; (3) the inner bore of exit cavity 108 which exhibits angled expansion at angle progressing from opening 106 to the distal end of exit cavity 108; and/or (4) the surfaces of flash suppressor 100 having chamfers and radii $R_1$, $R_2$, $R_3$, and $R_4$.

By virtue of its configuration, flash suppressor 100 may alter the gas flow path, which may help to inhibit or otherwise reduce secondary ignition of the combustible mixture of the muzzle gases from a discharged projectile and atmospheric oxygen in the ambient air, thereby reducing muzzle flash. For example, in some instances, observable muzzle flash may be reduced by about 60% or greater (e.g., in the range of about 60-70%, about 70-80%, about 80-90%, about 90-100%, or any other sub-range in the range of about 60-100%) as compared to the muzzle flash observable from an unsuppressed projectile weapon. Determination of the muzzle flash reduction achieved by a given flash suppressor 100 may be made, in accordance with some embodiments, by: (1) discharging a projectile weapon which does not host a flash suppressor 100 and measuring the resultant muzzle flash; (2) discharging the same projectile weapon having a flash suppressor 100 operatively coupled therewith and measuring the resultant muzzle flash; and (3) comparing the muzzle flash measurements. Other suitable techniques for determining the muzzle flash reduction efficacy of a flash suppressor 100 will depend on a given application and will be apparent in light of this disclosure.

The reduction in muzzle flash provided by flash suppressor 100 may help, in accordance with some embodiments: (1) to preserve the low-light vision (e.g., scotopic vision, device-based night vision) of the shooter; and/or (2) to reduce the visible signature of the shooter. Also, in accordance with an embodiment, flash suppressor 100 can be configured to be indexed with respect to muzzle 1004, for example, such that one of its prongs 104 is substantially oriented in the 12-o-clock position (e.g., near the top of the host weapon 1000). To that end, in some embodiments, socket portion 102 may include a stopping position which permits one of the prongs 104 to be substantially aligned with the shooter's line of sight down the length of the host weapon 1000. In some cases, this configuration may help to divert any remaining incandescent gases away from the line of sight of the shooter, thereby further helping to preserve the shooter's low-light vision.

Furthermore, as previously noted, and in accordance with some embodiments, flash suppressor 100 may provide for a degree of protection against damage to the flash suppressor 100 and/or host weapon 1000 as otherwise would result from a muzzle obstruction caused by foreign matter, component deformation, etc. In accordance with some embodiments, several features of flash suppressor 100 may contribute to that end, such as, for example: (1) the inner bore of exit cavity 108 which exhibits angled expansion at angle β; and/or (2) the surfaces of flash suppressor 100 having chamfers and radii $R_1$, $R_2$, $R_3$, and $R_4$. By virtue of its configuration, flash suppressor 100 may reduce the likelihood that foreign matter can become lodged within flash suppressor 100 and thus obstruct the muzzle 1004 of the host weapon 1000, in some embodiments. That is, in some cases, the outwardly expanding inner bore of exit cavity 108 (e.g., provided by the outwardly expanding inner surfaces of prongs 104) may prevent or otherwise reduce the opportunity for foreign matter to become lodged within or otherwise retained by flash suppressor 100. Some embodiments may reduce the likelihood that foreign matter which does become lodged within flash suppressor 100 will fail to eject/clear upon incidence with a discharged projectile. That is, in some cases, the outwardly expanding inner bore of exit cavity 108 (e.g., provided by the outwardly expanding inner surfaces of prongs 104) may permit foreign matter to be cleared from (e.g., blown out of) flash suppressor 100 with relative ease when struck by a discharged projectile. Some embodiments may increase the likelihood that, should flash suppressor 100 become deformed in a manner which (correctably) obstructs the muzzle 1004 of the host weapon 1000, a discharged projectile which is incident with the deformed portion of the flash suppressor 100 will provide some degree of corrective or otherwise counteractive deformation thereof. Thus, in some instances, flash suppressor 100 may improve the performance and reliability of the host weapon 1000 and safety to the shooter by realizing a reduction in the likelihood of mechanical failure of the weapon system.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A flash suppressor comprising:

a socket portion configured to couple with a muzzle of a projectile weapon, wherein the socket portion has an opening formed therethrough, the opening commensurate in size with an inner bore of the muzzle;

a plurality of prongs extending from the socket portion, wherein the prongs are arranged such that an interior space surrounded by the prongs provides an exit cavity, and wherein a first end of the exit cavity transitions to the opening of the socket portion and a second end of the exit cavity opens to allow passage of a projectile out of the flash suppressor, the exit cavity exhibiting angled expansion from the first end thereof to the second end thereof; and a plurality of multi-radius surfaces, each multi-radius surface formed between a neighboring pair of the plurality of prongs, wherein each multi-radius surface transitions from the exit cavity to an exterior of the flash suppressor.

2. The flash suppressor of claim 1, wherein each prong tapers in thickness along its length from the first end of the exit cavity to the second end of the exit cavity such that its inner surfaces diverge from a central axis of the flash suppressor.

3. The flash suppressor of claim 1, wherein each prong includes a chamfered end surface and/or a radiused end surface proximal the second end of the exit cavity.

4. The flash suppressor of claim 1, wherein the exit cavity exhibits angled expansion at an angle in the range of about 5°±2°.

5. The flash suppressor of claim 1, wherein each multi-radius surface exhibits angled expansion from the exit cavity to the exterior of the flash suppressor.

6. The flash suppressor of claim 1, wherein each multi-radius surface includes a portion which expands at an angle in the range of about 60°±5° relative to a central axis of the flash suppressor.

7. The flash suppressor of claim 1, wherein each multi-radius surface exhibits a first stage of angled radial width expansion at an angle in the range of about 10°±2°.

8. The flash suppressor of claim 7, wherein each multi-radius surface further exhibits a second stage of angled radial width expansion at an angle in the range of about 90°±5°, the first stage of angled radial width expansion more proximal to the exit cavity than the second stage of angled radial width expansion.

9. The flash suppressor of claim 1, wherein the flash suppressor has a generally cylindrical tubular geometry.

10. The flash suppressor of claim 1, wherein the plurality of prongs comprises three prongs spaced equidistantly from one another about a perimeter of the socket portion.

11. The flash suppressor of claim 1, wherein the socket portion is configured to receive a threaded muzzle.

12. The flash suppressor of claim 1, wherein the socket portion includes one or more set screws configured to tighten against an exterior of the muzzle.

13. The flash suppressor of claim 1, wherein the socket portion includes wrench flats formed therein.

14. The flash suppressor of claim 1, wherein all prong surfaces along a muzzle gas path are angled outwardly with respect to the muzzle in a direction from the muzzle to the second end of the exit cavity.

15. The flash suppressor of claim 1, wherein the exit cavity exhibits angled expansion at an angle which permits clearance of a muzzle obstruction upon incidence of a projectile therewith.

16. A projectile weapon comprising the flash suppressor of claim 1.

17. The projectile weapon of claim 16, wherein the projectile weapon comprises a pistol, a rifle, a machine gun, or an autocannon.

18. The projectile weapon of claim 16, wherein the projectile weapon is chambered for projectiles having a caliber in the range of 0.22 long rifle (LR) rounds to 30 mm rounds.

19. The projectile weapon of claim 16, wherein the projectile weapon comprises a rifle chambered for 5.56×45 mm NATO rounds.

20. The projectile weapon of claim 16, wherein the projectile weapon comprises a rifle chambered for 7.62×39 mm rounds.

21. The projectile weapon of claim 16, wherein the socket portion of the flash suppressor includes a stopping position which permits one prong of the plurality of prongs to be indexed at a 12-o-clock position with respect to the muzzle.

* * * * *